US011685160B2

(12) United States Patent
Smith et al.

(10) Patent No.: US 11,685,160 B2
(45) Date of Patent: Jun. 27, 2023

(54) TRANSFERRING AND MIXING INKS FOR PRINTING

(71) Applicant: Hewlett-Packard Development Company, L.P., Spring, TX (US)

(72) Inventors: David L. Smith, Corvallis, OR (US); Nicholas J. Meisner, Corvallis, OR (US); Robert K. Saathoff, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/819,755

(22) Filed: Aug. 15, 2022

(65) Prior Publication Data

US 2022/0388310 A1 Dec. 8, 2022

Related U.S. Application Data

(63) Continuation of application No. 17/255,621, filed as application No. PCT/US2019/015898 on Jan. 30, 2019, now Pat. No. 11,453,218.

(51) Int. Cl.
*B41J 2/175* (2006.01)
*B41J 2/18* (2006.01)

(52) U.S. Cl.
CPC ..... *B41J 2/175* (2013.01); *B41J 2/18* (2013.01)

(58) Field of Classification Search
CPC . B41J 2/17596; B41J 2/18; B41J 2/175; B41J 2/17513
See application file for complete search history.

(56) References Cited

U.S. PATENT DOCUMENTS

| | | | |
|---|---|---|---|
| 5,886,721 | A | 3/1999 | Fujii et al. |
| 6,663,233 | B2 | 12/2003 | Otsuka et al. |
| 8,057,030 | B2 | 11/2011 | Hamano |
| 8,210,666 | B2 | 7/2012 | Hirashima |
| 8,371,684 | B2 | 2/2013 | Smith et al. |
| 8,529,029 | B2 | 9/2013 | Szusdziara et al. |
| 9,616,674 | B2 * | 4/2017 | De Saint Romain ..... B41J 2/17513 |
| 10,035,356 | B2 | 7/2018 | Encrenaz et al. |
| 2003/0007040 | A1 | 1/2003 | Love et al. |
| 2010/0110155 | A1 | 5/2010 | Delueg |
| 2012/0140003 | A1 | 6/2012 | Szusdziara et al. |
| 2012/0169813 | A1 | 7/2012 | Gray et al. |
| 2012/0194619 | A1 | 8/2012 | Smith et al. |
| 2015/0283819 | A1 | 10/2015 | Sanaei et al. |

(Continued)

FOREIGN PATENT DOCUMENTS

| | | | |
|---|---|---|---|
| CN | 1200080 | A | 11/1998 |
| CN | 102753351 | A | 10/2012 |

(Continued)

*Primary Examiner* — An H Do

(57) ABSTRACT

According to examples, systems and methods for transferring and mixing ink utilizing a tank with a mixing area formed by a funnel portion are described. The mixing area is for mixing new ink and resident ink. In some examples, a new ink supply inlet tube deposits the new ink into the tank from a connected ink supply container. In some examples, a resident ink supply inlet tube deposits the resident ink into the tank from a connected printing device. In some examples, an outlet port situated at tank bottom sends the mixed ink to the printing device.

18 Claims, 8 Drawing Sheets

(56) References Cited

U.S. PATENT DOCUMENTS

| | | | |
|---|---|---|---|
| 2016/0082746 | A1 | 3/2016 | De Saint Romain |
| 2017/0144448 | A1 | 5/2017 | Smith |

FOREIGN PATENT DOCUMENTS

| | | | |
|---|---|---|---|
| CN | 108472954 | A | 8/2018 |
| WO | 2010/032984 | A2 | 3/2010 |

* cited by examiner

TRANSFERRING AND MIXING INKS FOR PRINTING

BACKGROUND

A conventional inkjet printing system includes one or more printheads and an ink supply which supplies liquid ink to the printheads. The printheads eject ink drops through a plurality of nozzles and toward a print substrate, such as a sheet of paper, so as to print onto the print substrate. One example of a printing system used for commercial graphics printing is a web-fed press, which applies the print agents to a web substrate fed to the printing system by a substrate roll feeder system. After application of the print agents, the printed upon substrate may be collected on a re-winder drum or cut into sheets. Another example of a printing system used for commercial graphics printing is a sheet fed printing system, which applies the print agents to a sheet substrate rather than a continuous web. Both web fed and sheet fed printing systems can print a large swaths at high speeds. For example, the HP PageWide T1100S color inkjet web fed press can print corrugated liners with a 2.8 m width at speeds of up to 30,600 $m^2$ per hour.

DETAILED DESCRIPTION

Figure 1:
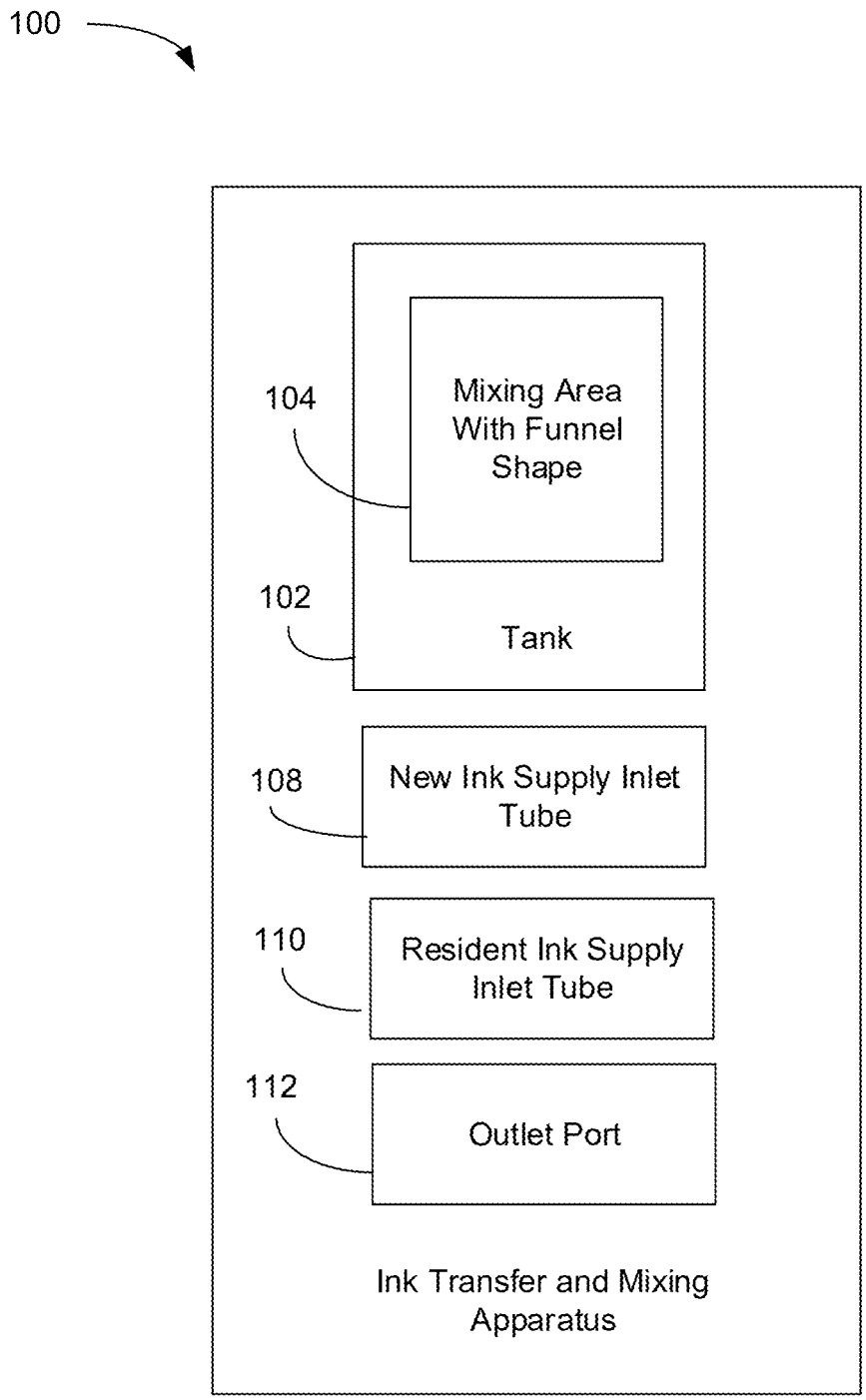
FIG. 1 is a block diagram depicting an example of an apparatus for transferring and mixing inks for printing utilizing an intermediate tank.

One of the challenges of inkjet printing is that pigment-based inkjet inks are prone to pigment settling. Inconsistent pigment loading in inkjet printing ink results in image quality anomalies. One approach is to mitigate pigment settling in inkjet inks prior to printing, e.g., to mix the ink in the supply container prior to evacuating the ink. For large commercial graphics printing devices, however, mixing the ink in the container prior to removing the ink from the container is often not practical. Supply containers for commercial graphic inkjet printers are commonly 20 to 1000 liters in volume, and are not conducive to the shake mixing that might be effective for a smaller printer ink supply (e.g., an inkjet cartridge for a desktop printer). And while having a supply and return connection at the supply container to enable recirculation mixing within the ink supply is feasible for some commercial graphics printing applications, other applications utilize ink supply containers with a single connection to the printing system that does not facilitate recirculation mixing. For example, cost effective "bag in box" supply containers (in which a bag holding ink collapses as the ink is evacuated) typically have a single needle/septum connection with the printing system and thus are not conducive to ink recirculation.

To address these issues, various examples described in more detail below provide a system and a method for ink transfer and mixing when utilizing large ink supply containers common to commercial graphics printing. The disclosed solution addresses pigment settling/mixing for bag in box supplies by transferring a supply volume of new ink, at one time, into an intermediate tank with the shape of a funnel or an inverted cone. In examples, the ink flow enters the tank through an inlet tube that is elevated and angled away from the outlet port so that ink circulates up and radially around the intermediate tank to mix the new ink with resident ink from the printing device that is also being introduced into the tank. The transfer and mixing are done at a flow rate that allows the new ink and the resident ink to be well mixed prior to reaching an outlet port on the bottom of the intermediate tank and being pumped to printheads at the printing device.

In certain examples, the transferring of the new ink from the supply container to the mixing area includes transferring a total volume of new ink in the supply container without interruption. In certain examples, a sensor is utilized to determine ink level in the intermediate tank. Upon determination that mixed ink in the intermediate tank has dropped below a refill threshold level, the system initiates an additional transfer of ink to the mixing area from a new supply container. In yet another example, upon determination that mixed ink in the intermediate tank has dropped below an empty/stop operations threshold level, the system causes printing operations to stop so as to not damage the printing device.

In this manner, the disclosed method, ink mixing apparatus, and printing device provide for effective and efficient mixing in an intermediate tank of new ink from a supply container and resident ink already in the printing device. The disclosed method promotes consistent pigment uniformity for printing, and improved print quality. Users and providers of inkjet printer systems will appreciate these improvements in print quality, and will further appreciate the reductions in damage to printing system components and reductions in downtime afforded by the disclosed examples. Users and providers of inkjet printer systems will further appreciate that a series of ink supply containers can be staged and sequentially connected to the intermediate tank ready for access when the ink level in the intermediate tank reaches a threshold level. This allows for adding new ink to the printing system without interrupting printing operations. Installations and utilization of inkjet printers that include the disclosed method, ink mixing apparatus, and printing device should thereby be enhanced.

FIG. 1 is a block diagram depicting an example of an apparatus 100 for transferring and mixing inks for printing utilizing an intermediate tank. In this example, apparatus 100 includes an intermediate tank 102 for mixing new ink from a connected supply container and resident ink from a connected printing device. As used herein, "tank" refers generally to any receptacle or storage chamber capable of holding liquid ink. In examples, intermediate tank 102 may be a tank made of plastic or any other polymer composition. In other examples, intermediate tank 102 could be made of other materials such as a metal (e.g., aluminum or steel), ceramic, or glass.

As used herein, a "printing device" is synonymous with a "printer", and refers generally to any electronic device or group of electronic devices that consume a marking agent to produce a printed print job or printed content. In examples, a printer may be, but is not limited to, a liquid inkjet printer, a liquid toner-based printer, or a multifunctional device that performs a function such as scanning and/or copying in addition to printing. As used herein, a "print job" refers generally to content, e.g., an image, and/or instructions as to formatting and presentation of the content sent to a computer system for printing. In examples, a print job may be stored in a programming language and/or a numerical form so that the job can be stored and used in computing devices, servers, printers and other machines capable of performing calculations and manipulating data. As used herein, an "image" refers generally to a rendering of an object, scene, person, or abstraction such text or a geometric shape. In certain examples, a "printing device" may be a 3D printer. In certain examples, the printed print job or printed content may be a 3D rendering created by a 3D printer printing upon a bed of marking agent or other build material.

Intermediate tank 102 has a mixing area 104 that is formed by a funnel shaped, or inverted conical shaped, portion of intermediate tank 102. In certain examples the mixing area 104 of intermediate tank 102 is made of the same material as the non-mixing areas (e.g., the portion above the mixing area) of the tank. In other examples, mixing area 104 may be made of different material than the non-mixing area. In certain examples, the mixing area portion 104 and non-mixing areas of intermediate tank 102 may be made from a same material, yet have different wall thicknesses.

Continuing at FIG. 1, apparatus 100 includes a new ink supply inlet tube 108 for depositing into intermediate tank 102 the new ink from a connected ink supply container. In examples, new ink supply inlet tube 108 may be connected via tubing, e.g. new ink connective tubing (206 FIG. 2A), to a "bag in box" supply container (a box container holding a collapsible bag, with the bag holding the new ink). The bag is to collapse as the ink is evacuated. In examples, new ink supply inlet tube 108 may be connected direct or indirectly, e.g., via removable new ink connective tubing (206 FIG. 2A), to an ink supply container that has a single needle/septum connection with the tubing.

Apparatus 100 includes a resident ink supply inlet tube 110 for depositing into intermediate tank 102 ink, via resident ink connective tubing (208 FIG. 2A), from a connected printing device (referred to herein as "resident ink"). In examples, the resident ink may be ink that originated from (e.g., was transferred to the printing device from) an ink supply container, but has circulated through the printing device as a result of a printing operation, a pre-printing operation (e.g., a print device warm-up routine), or a servicing operation (e.g., an ink spitting routine to clear a clogged printhead). In examples, resident ink supply inlet tube 110 may be connected directly or indirectly, to the printing device via connective tubing.

In examples, new ink supply inlet tube 108 and resident ink supply inlet tube 110 may be made of a metal, a plastic or other polymer, or any other material capable of transferring liquid ink into mixing area 104. In certain examples, each of the new ink supply inlet tube 108 and the resident ink supply inlet tube 110 has a first length that extends upward from the tank bottom, and a second length that is angled outward towards a wall of the intermediate tank. In a particular example, the second length of one or both of new ink supply inlet tube 108 and resident ink supply inlet tube 110 are angled between 20 degrees and 25 degrees from vertical. This arrangement is to allow, with the assistance of a transfer pump to provide pressure, the new ink and the resident ink to be sprayed upon the interior walls of mixing area 104. The new ink and the resident ink are to be sprayed upon the interior walls of funnel shaped, or inverted conical shaped, mixing area 104 with force sufficient to cause the new ink and the resident ink to circulate and mix in mixing area 104.

Continuing at FIG. 1, apparatus 100 includes an outlet port 112 that is situated at the bottom of intermediate tank 102. Outlet port 112 is for sending the mixed ink to the printing device that was the source of the resident ink. The mixed ink is a mixture of new ink from the ink supply container and resident ink from the printing device, where the mixing occurs in funnel-shaped or inverted conical-shaped mixing area 104.

Figure 2:
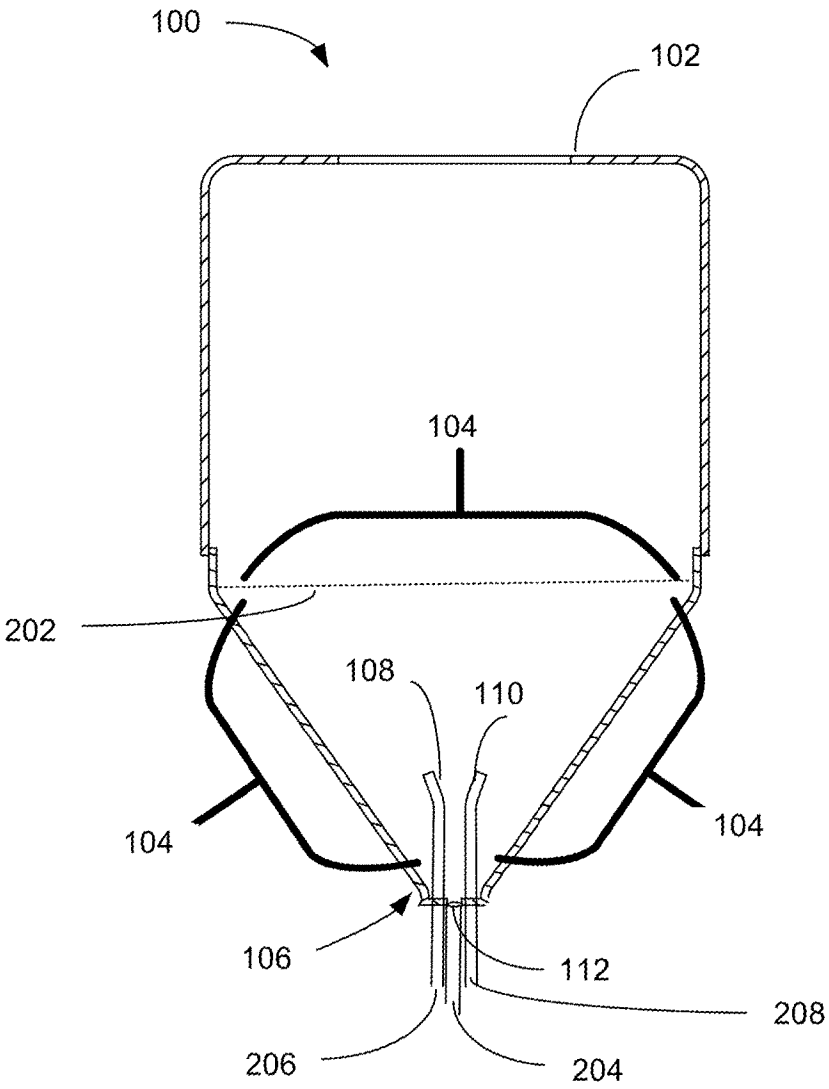
FIG. 2 is a schematic diagram showing a cross-section view of an example of an apparatus for transferring and mixing inks for printing.

FIG. 2 is a schematic diagram showing a cross-section view of an example of an apparatus 100 for transferring and mixing inks for printing. In this example, apparatus 100 includes an intermediate tank 102 that has a mixing area 104 formed by a funnel or inverted conical portion of the tank. Mixing area 104 is for mixing new ink and resident ink. In the example of FIG. 2, the top or upper boundary 202 of the mixing area 104 is indicated by a horizontal broken line that extends across the diameter of intermediate tank 102.

Apparatus 100 includes a new ink supply inlet tube 108 for depositing into intermediate tank 102 the new ink from a connected ink supply container (not shown in FIG. 2), and a resident ink supply inlet tube 110 for depositing into intermediate tank 102 the resident ink from a connected printing device (not shown in FIG. 2). In examples, the deposits of the new ink and the resident ink into mixing area 104 are contemporaneous to cause mixing of the new ink and the resident ink Apparatus 100 includes an outlet port 112 situated at the bottom 106 of intermediate tank 102. Outlet port 112 is for sending the mixed ink to the connected printing device via a mixed ink outlet tubing 204.

Figure 3B:
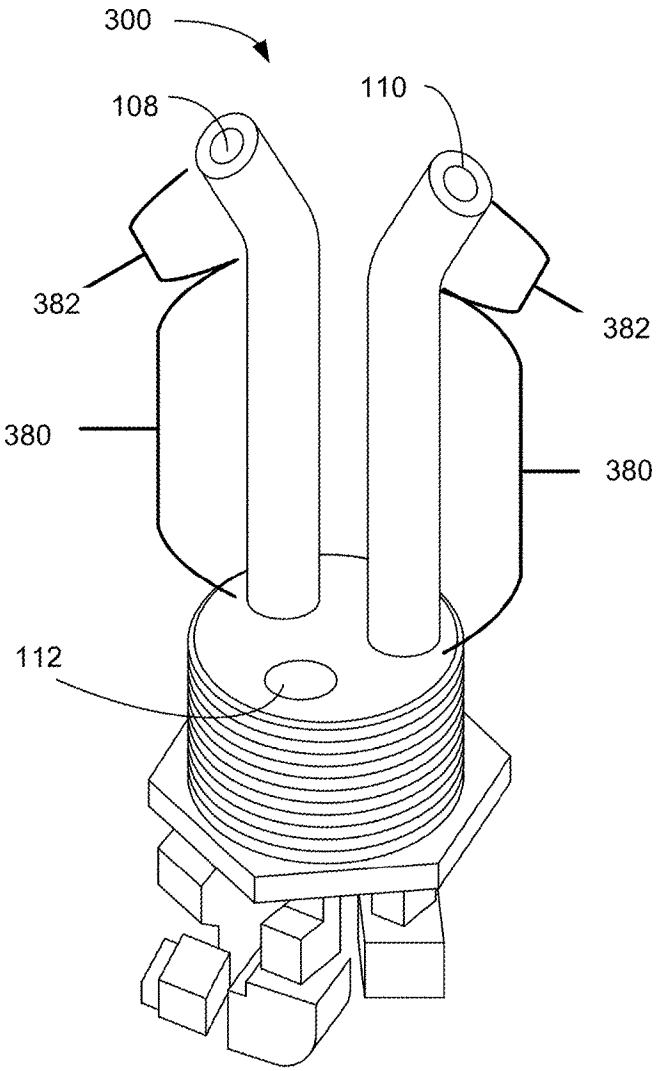
FIG. 3B is a perspective view of an example of a component to be seated at the bottom of an intermediate tank, the component including or holding a new ink supply inlet tube, a resident ink supply inlet tube, and an outlet port.
Figure 3A:
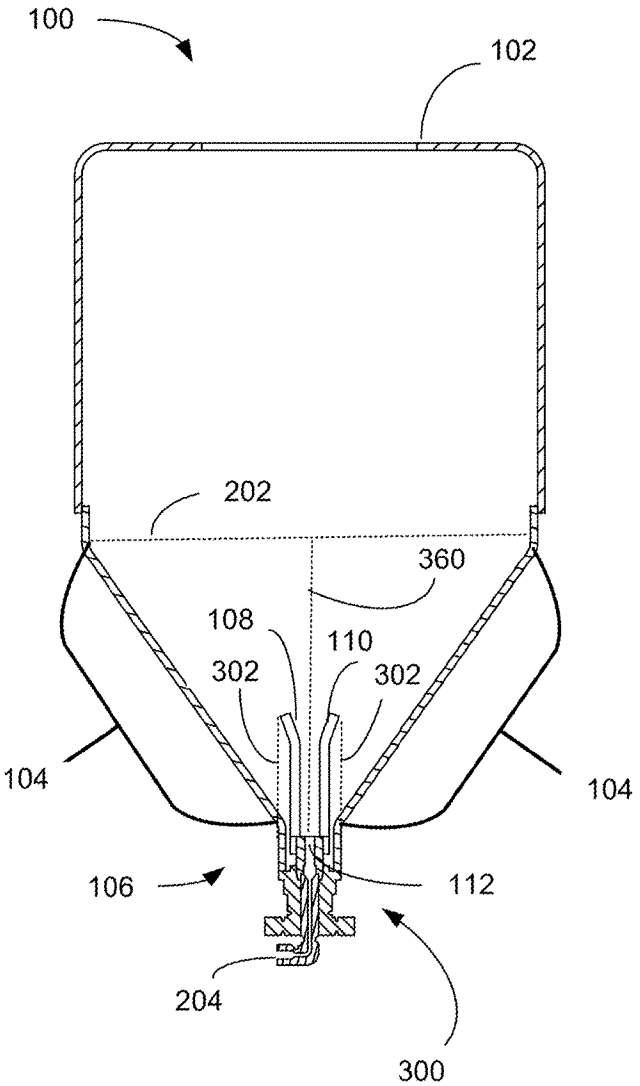
FIG. 3A is a schematic diagram showing a cross-section view of another example of an apparatus for transferring and mixing inks for printing.

FIG. 3A is a schematic diagram showing a cross-section view of another example of an apparatus 100 for transferring and mixing inks for printing. In this example, apparatus 100 includes an intermediate tank 102 that has a mixing area 104 formed by a funnel or inverted conical portion of the tank. Mixing area 104 is for mixing new ink and resident ink. Apparatus 100 includes a new ink supply inlet tube 108 for depositing into intermediate tank 102 the new ink from a connected ink supply container (not shown in FIG. 3A), and a resident ink supply inlet tube 110 for depositing into intermediate tank 102 the resident ink from a connected printing device (not shown in FIG. 3A). Apparatus 100 includes an outlet port 112 situated at the bottom of intermediate tank 102. Outlet port 112 is for sending the mixed ink to the connected printing device via a mixed ink outlet tube 204.

FIG. 3B is a perspective view of an example an integrated component 300 that can be seated at the bottom of an intermediate tank 102 (FIG. 3A). In this example, integrated component 300 includes all or a portion of new ink supply inlet tube 108, resident ink supply inlet tube 110, and outlet port 112. In an example, the integrated component may include a plastic or other polymer composition, metal, rubber (e.g., for a gasket or for a seating member), and/or other materials. In this example, each of new ink supply inlet tube 108 and resident ink supply inlet tube 110 has a first length 380 that is to extend upward from the tank bottom (106 FIG. 3A), and a second length 382 that is to be angled outward towards a wall of intermediate tank 102 in the mixing area 104 (FIG. 3A). The angled structure allows, with the assistance of a transfer pump to provide sufficient pressure, the new ink and the resident ink to be sprayed upon the interior walls of intermediate tank 102 in mixing area 104.

Returning to FIG. 3A, in examples new ink supply inlet tube 108 and resident ink supply inlet tube 112 each extend vertically though the bottom of the shaped intermediate tank, with each having a height 302 that is sufficient to extend into mixing area 104 well above the outlet port 112. The heights of new ink supply inlet tube 108 and resident ink supply inlet tube 112 are to be tall enough to ensure the new ink and the resident ink will be deposited by new ink supply inlet tube 108 and resident ink supply inlet tube 112 onto the funnel or inverted conical shaped walls of intermediate tank 102 in the mixing area 104. The new ink and the resident ink are to be deposited with sufficient force to cause the inks to circulate around, e.g., radially, the interior walls of the funnel or inverted conical shaped mixing area before exiting via outlet port 112. In particular examples the heights of one or both of new ink supply inlet tube 108 and resident ink supply inlet tube 112 are between 5% and 30% of the height 360 of the mixing area 104. In the example of FIG. 3A, the height 360 of the mixing area 104 is indicated by a broken line which extends vertically from bottom of intermediate tank 102 to the top upper boundary 362 of the funnel shaped or inverted conical shaped mixing area 104. In the example of FIG. 3A, the top or upper boundary 202 of mixing area 104 is indicated by a horizontal broken line that extends across the diameter of intermediate tank 102.

Figure 4:
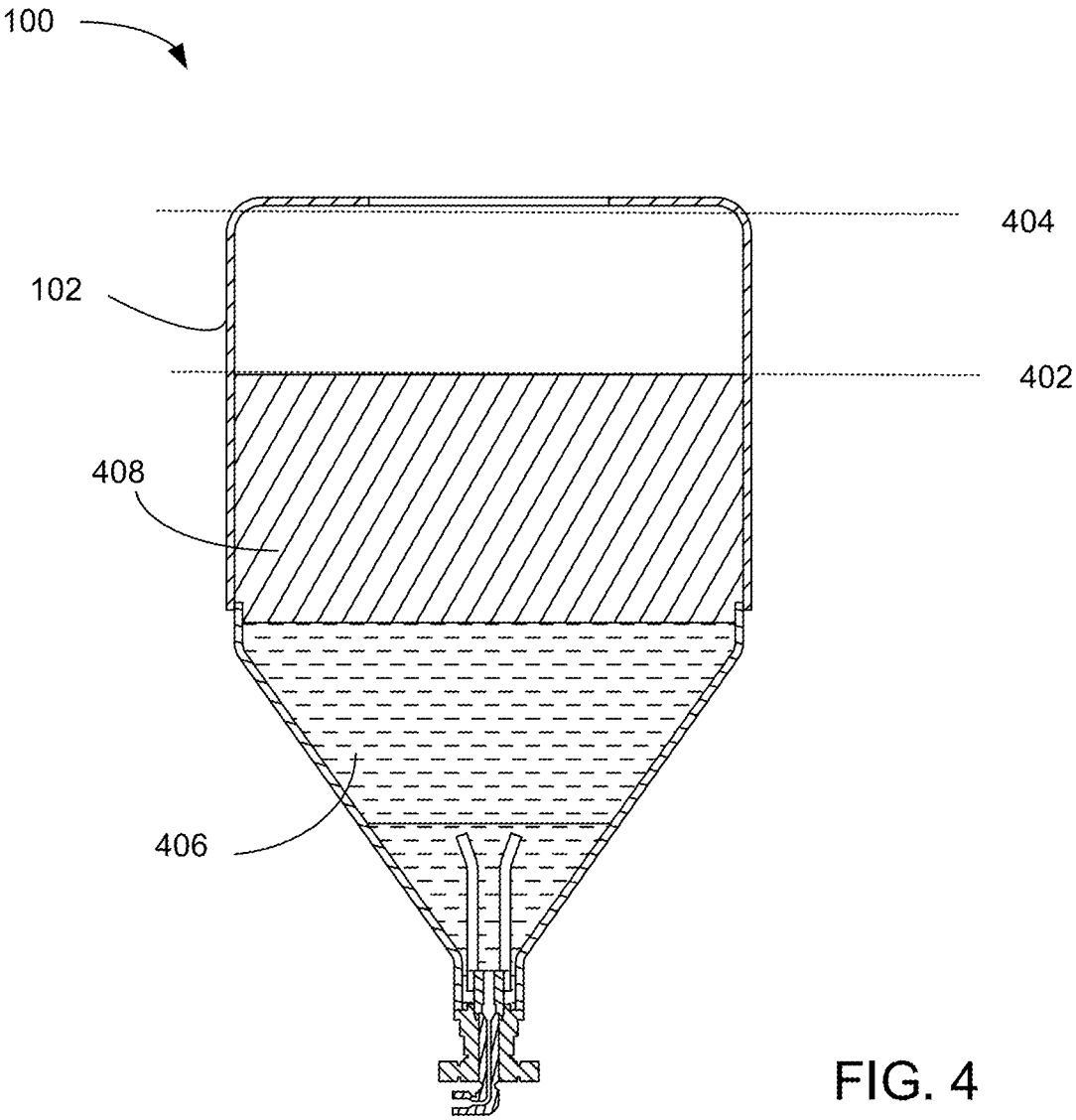
FIG. 4 is a schematic diagram showing a cross-section view of an example of an apparatus for transferring and mixing inks for printing, wherein the intermediate tank is full after a transfer of ink from an ink supply container.

FIG. 4 is a schematic diagram showing a cross-section view of an example of an apparatus 100 for transferring and mixing inks for printing wherein the intermediate tank 102 is full after a transfer of all ink from an ink supply container. In this example "full" means that the ink has reached or exceeded a threshold of liquid volume that has been predetermined to be a maximum desired capacity for intermediate tank 102 (a "full threshold 402). In this example the ink in intermediate tank 102 includes a first volume of ink 406 in the mixing area 104 denoted with horizontally hashed lines, and second volume of ink 408 in an area of intermediate tank 102 above mixing area 104, the second volume of ink indicated by diagonal hashed lines.

In the example of FIG. 4, "full" is actually a threshold volume point that is less than having intermediate tank 102 be filled to a point that is the maximum physically possible 404. Overfilling intermediate tank 102 to the point of ink spillage or creating abnormal pressures in intermediate tank 102 would be a highly detrimental event in terms of damage to equipment, lost time, and ruined print jobs. Having the system recognize a "full" threshold be a detected volume that is less than actual physical capacity of intermediate tank 102, then, affords margin for error such that a sensor error is less likely to result in damaged equipment.

Figure 5B:
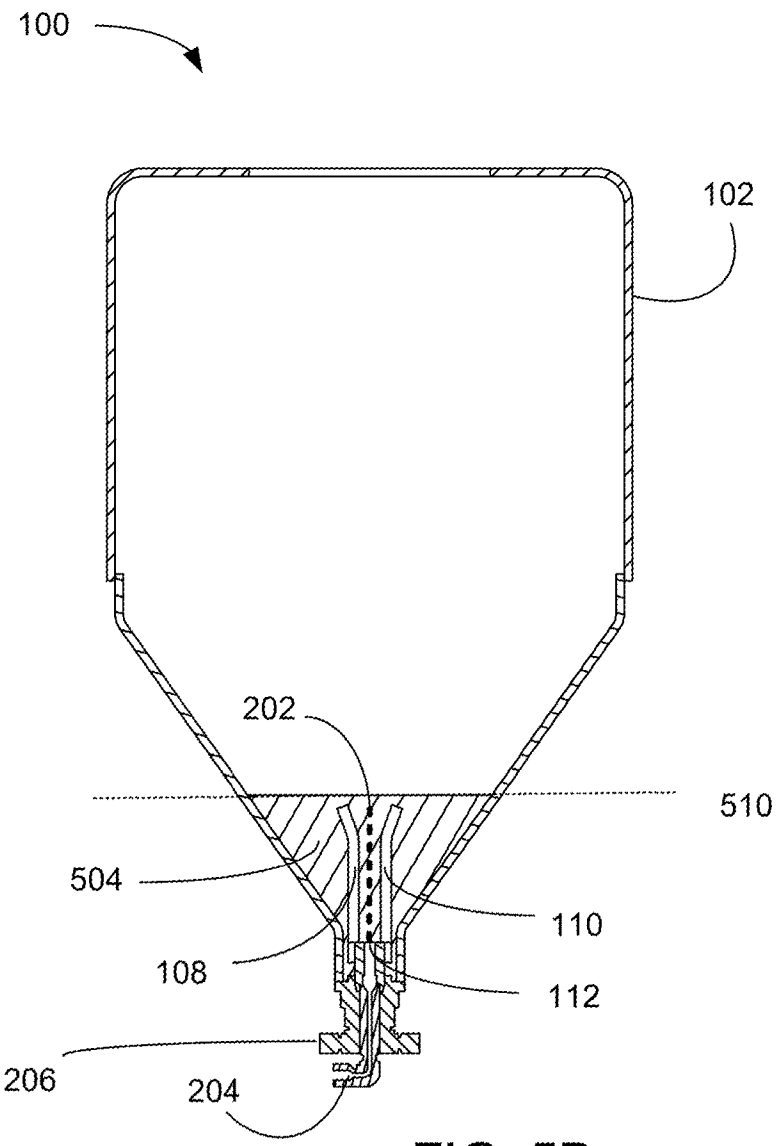
FIG. 5B is a is a schematic diagram showing a cross-section view of an example of an apparatus for transferring and mixing inks for printing, wherein the ink level in the intermediate tank is at or below an empty/stop operations level, and printing operations are to be shut down.
Figure 5A:
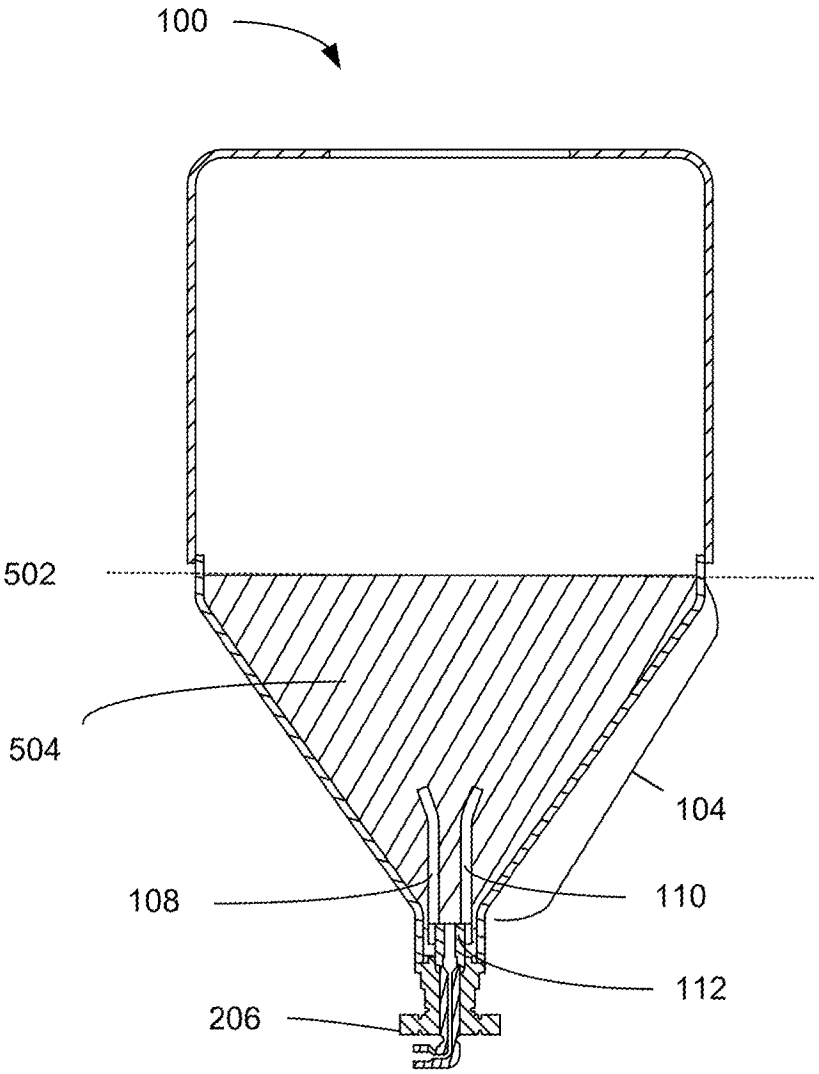
FIG. 5A is a schematic diagram showing a cross-section view of an example of an apparatus for transferring and mixing inks for printing, wherein the ink level in the intermediate tank is deemed low and the system is ready for transfer of additional ink into the intermediate tank from an ink supply container.

FIG. 5A is a schematic diagram showing a cross-section view of another example of apparatus 100 for transferring and mixing inks for printing. In this example, apparatus 100, upon a determination (e.g., receiving data originating from a sensor) that the mixed ink 504 in intermediate tank 102 is at or beneath the ink low threshold level 502, initiates an additional transfer of ink into mixing area 104 from a new or fresh ink supply container. In this example the ink low threshold level 502 is a fluid level that is between a tank "full" level (402 FIG. 4) and a tank empty/stop operations level (510 FIG. 5B), and has been predetermined to be an ideal level for initiating a resupply of intermediate tank 102. Connecting a new or fresh ink supply container, directly or indirectly, to new ink supply inlet tube 108 (e.g. by connecting to new ink connective tube 206 that connects to new ink supply inlet tube 108) at the time that "low" level 502 is indicated is to allow enough time for the refilling of mixing area 104 without having to stop printing operations. In other words, printing operations do not need to be suspended because at the "low" level 502 there is enough mixed ink in mixing area 104 to sustain printing operations through the refill process assuming the refill operation proceeds at an expected rate. Suspending print operations to enable refilling can be highly detrimental to commercial printing schedules. Causing refilling at a time that is far enough in advance of the ink level reaching an empty/stop operations level will result in significant savings in terms of time and increased productivity. In an example, "initiating" transfer may include sending a user message or instruction that a new or fresh ink supply container needs to be moved into proximity of intermediate tank 102, and connected to new ink supply inlet tube 108, e.g., via new ink connective tubing 206. In another example, "initiating" transfer may include automatically moving a new or fresh ink supply container into proximity of intermediate tank 102, and connecting the new ink supply container to new ink supply inlet tube 108 via new ink connective tubing 206. It should be noted that while in the example of FIG. 5A the low threshold level is a level that is the top of funnel or inverted conical-shaped mixing zone 104, in other examples the low threshold level could be a predetermined threshold level this higher than, or lower than, threshold level 502 depicted in FIG. 5A.

FIG. 5B is a is a schematic diagram showing a cross-section view of an example of an apparatus for transferring and mixing inks for printing, wherein the ink level in the intermediate tank has fallen below the low threshold level (502 FIG. 5A) to an empty/stop operations level 510, and printing operations are to be shut down. The change in ink levels may be due to the printing device having utilized the mixed ink that had resided in mixing areas 104 more before the ink level could be replenished by adding ink from a new ink supply container. In this example, upon determining the mixed ink 504 level in intermediate tank 102 is at or beneath the empty/stop operations level 510, apparatus 100 causes an immediate cessation of printing operations. In one example, printing operations may only resume after there has been a transfer of additional ink from an ink supply container into intermediate tank 102. Should the mixed ink 504 level drop below the output port 112, output port 112 would draw air into the mixed ink output tubing 204 that leads to the printheads of the printing device and serious damage to the printing device, a ruined print job, and delays for repair may result. While in the example of FIG. 5B the empty/stop operations threshold level is a level that is roughly even with the height 302 of new ink supply inlet tube 108 and resident ink supply tube 110, in other examples the stop operations threshold level could be a predetermined threshold level this higher than, or lower than, empty/stop operations threshold level 510 depicted in FIG. 5B.

Figure 6B:
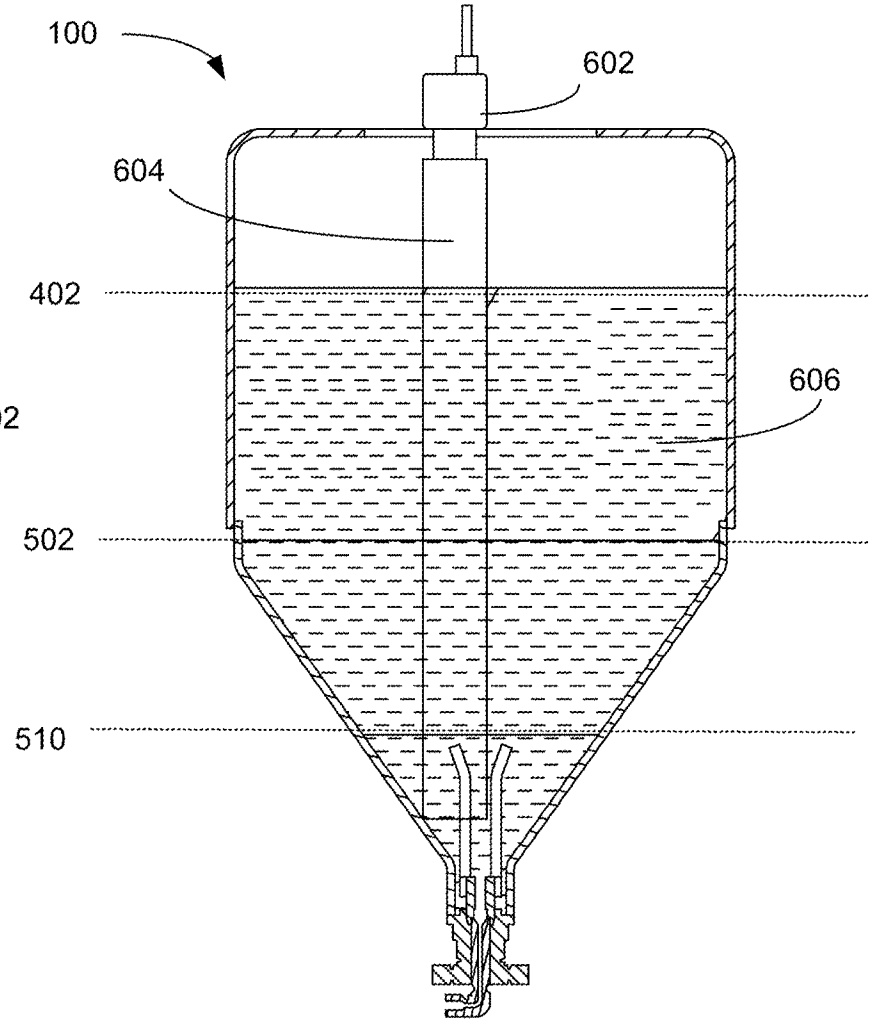
FIGS. 6A and 6B are schematic diagrams showing cross-section views of an example of an apparatus for transferring and mixing inks for printing, wherein the system includes a sensor that is to direct a sense beam towards the mixing area.
Figure 6A:
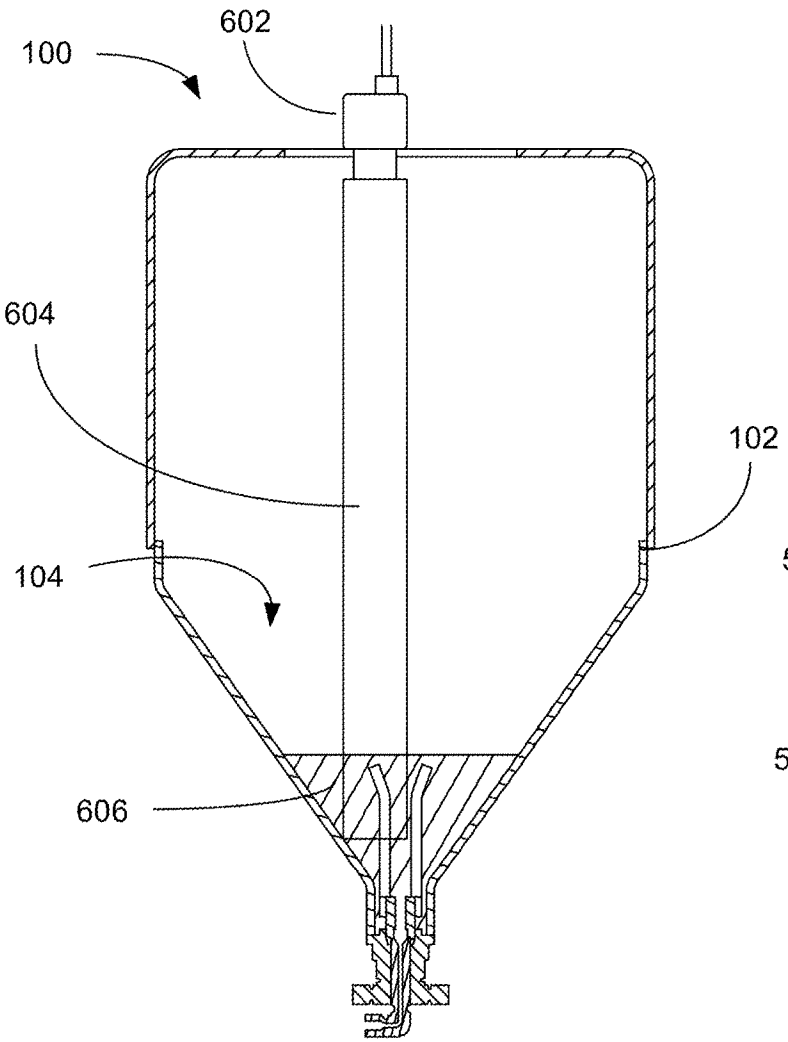

In an example depicted in FIG. 6A ink transfer and mixing apparatus 100 may include a sensor 602 for determining ink levels in the intermediate tank 102. In examples sensor 602 may be any sensor type that directs a sense beam 604 towards mixing area 104 to detect the level or volume of ink 606 in the intermediate tank 102. In examples, sensor 602 may be an ultrasonic level sensor, a radar level transmitter, a guided microwave level transmitter, or any type of level or volume sensor. Moving to FIG. 6B in view of FIGS. 4, 5A, and 5B, sensor 602 may direct a sense beam 604 towards mixing area 104 to detect that ink in intermediate tank is at an ink full threshold 402, an ink low threshold level 502, and/or an empty/stop operations level 510.

Figure 7:
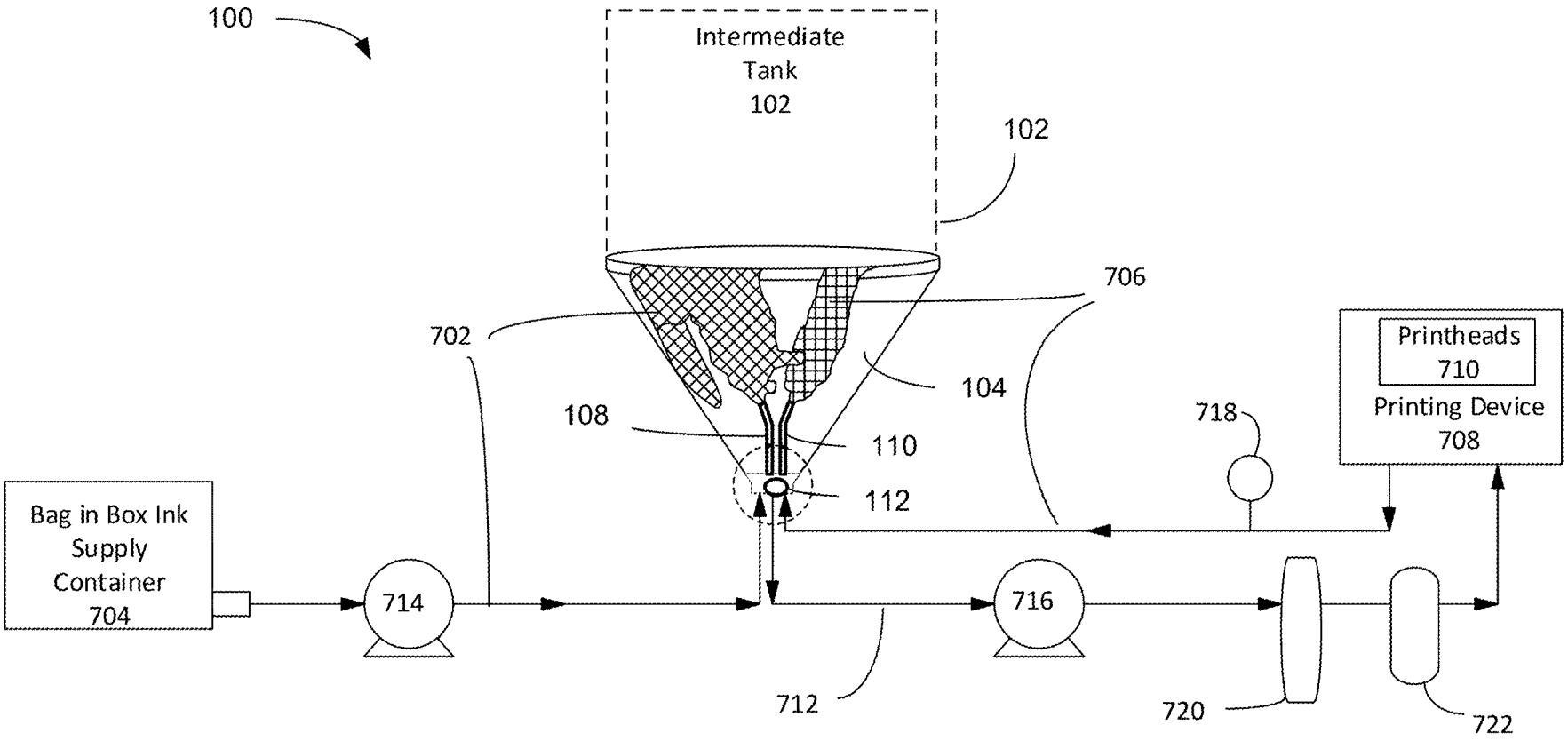
FIG. 7 is a simple schematic diagram that illustrates an example of a printing system that includes an intermediate tank with an inverted conical shape mixing area for mixing new ink from an ink supply container and resident ink from a printing device.

FIG. 7 is a simple schematic diagram that illustrates an example of a printing system 700 that includes an intermediate tank 102 with a funnel or inverted conical shape mixing area 104 for mixing new ink 702 from an ink supply container 704 and resident ink 706 from a printing device 708. In this example, printing device 708 may be an inkjet web fed printing device that delivers ink to media utilizing a set of printbars, with each printbar including a set of printheads 710. In other examples, printing device 708 may be any other type of printing device that consumes liquid ink.

Intermediate tank 102 is connected by tubing to printing device 708 and new ink supply container 704. Intermediate tank 102 includes a mixing area 104 formed by an inverted conical shape or a funnel shape for mixing new ink 702 and resident ink 706. Intermediate tank 102 includes an outlet port 112 situated at the bottom 106 of tank bottom 102, the outlet port 112 for sending mixed ink 712 to the printheads 710.

Continuing at FIG. 7, Printing system 700 includes a new ink supply inlet tube 108 connected to intermediate tank 102. New ink supply inlet tube 108 is for streaming into the tank the new ink 702 from the connected ink supply container 704. Printing system 700 includes a resident ink supply inlet tube 110 connected to intermediate tank 102 and printing device 708. Resident ink supply inlet tube 110 is for streaming into the tank resident ink 706 from printing device 708. In the example of FIG. 7 both the new ink supply inlet tube 108 and resident ink inlet tube have a first length that extends vertically from bottom of the conically shaped tank, and a second length that is angled from vertical, to cause the spraying of new ink 702 and resident ink 706 onto the interior walls of mixing area 104 of tank 102.

Printing system 700 includes a transfer pump 714 connected to new ink supply inlet tube 108 and situated in line between ink supply container 704 and intermediate tank 102. Transfer pump 714 is to cause the transfer of new ink 702 from ink supply container 704 to intermediate tank 102. Printing system 700 includes a pressure pump 716 connected to resident ink supply inlet tube 110 and situated in line between printing device 708 and intermediate tank 102.

Pressure pump 716 is to cause the transfer of mixed ink 712 from intermediate tank 102 to printing device 708 in order that mixed ink 712 can be ejected by printheads 710. In this example pressure sensor 718 is connected to the tubing for connecting outlet port 112, printing device 708, and resident ink supply inlet tube 110. Pressure sensor 718 is to measure the pressure at which mixed ink 712 is being provided to the printing device and/or the pressure at which resident ink being sent to mixing area 104 via resident ink supply inlet tube 110.

Continuing at FIG. 7, printing system 700 includes a filter 720 and a degas unit 722 that are connected by tubing with outlet port 112 and are connected by tubing with printing device 708. Filter 720 is for removing contaminants from mixed ink 712 prior to the mixed ink being utilized in a printing operation at printing device 708. Degas unit 722 is for removing bubbles in mixed ink 712 prior to the printheads 710 at printing device 708 ejecting mixed ink 712 upon a media.

Figure 8:
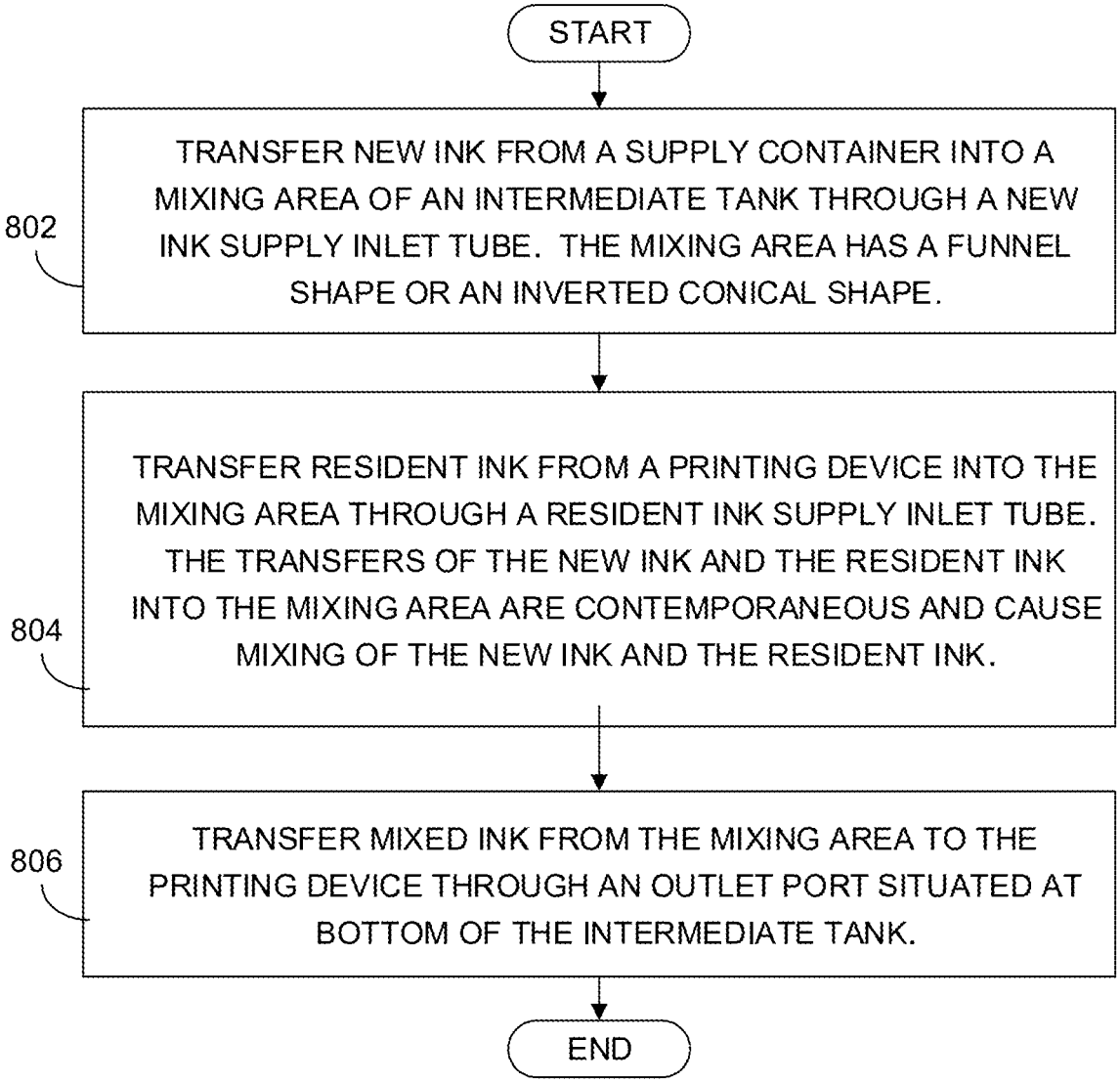
FIG. 8 is a flow diagram depicting an example implementation of a method for transferring and mixing inks for printing utilizing an intermediate tank.

FIG. 8 is a flow diagram of implementation of a method for transferring and mixing ink. In an example, ink is transferred from a supply container into a mixing area of an intermediate tank through a new ink supply inlet tube. The mixing area has a funnel shape or an inverted conical shape (block 802).

Resident ink is transferred from a printing device into the mixing area through a resident ink supply inlet tube. The transfers of the new ink and the resident ink into the mixing area are contemporaneous and cause mixing of the new ink and the resident ink (block 804).

Mixed ink is transferred from the mixing area to the printing device through an outlet port situated at bottom of the intermediate tank (block 804).

FIGS. 1-8 aid in depicting the architecture, functionality, and operation of various examples. In particular, FIGS. 1-7 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function (s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 8 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. An apparatus, comprising:

a tank including a mixing area;

a first inlet to input new ink into the mixing area; and a second inlet to input resident ink into the mixing area, wherein at least one of the first inlet or the second inlet extends from a bottom of the tank, and wherein the first inlet is oriented in a direction to cause the new ink to flow along a side wall of the mixing area of the tank to mix the new ink with the resident ink.

2. The apparatus of claim 1, wherein the second inlet is oriented in a direction to cause the resident ink to flow along the side wall of the mixing area.

3. The apparatus of claim 1, wherein the side wall of the mixing area is curved.

4. The apparatus of claim 3, wherein the first inlet directs the new ink onto the curved side wall of the mixing area of the tank at said rate sufficient to mix the new ink with the resident ink.

5. The apparatus of claim 1, wherein the first inlet is coupled to receive the new ink from an ink supply source having a bag-in-box configuration.

6. The apparatus of claim 1, wherein the second inlet is coupled to receive the resident ink from a printer.

7. The apparatus of claim 1, wherein the first inlet is oriented in a direction that circulates the new ink up and radially around the side wall of the mixing area of the tank.

8. The apparatus of claim 1, wherein the first inlet is to supply a continuous flow of the new ink into the mixing area of the tank until a mixture of the new ink and resident ink reaches a predetermined level in the tank.

9. The apparatus of claim 1, wherein the first inlet is to supply the continuous flow of the new ink into the mixing area during a printing operation performed by a printer coupled to the second inlet.

10. The apparatus of claim 1, wherein the first inlet and the second inlet extend from the bottom of the tank.

11. The apparatus of claim 1, further comprising:

an integrated component including a first area, a second area, and an outlet, wherein the first area includes the first inlet, the second area includes the second inlet, and the outlet outputs a mixture of the new ink and resident ink to a printer.

12. The apparatus of claim 1, wherein the first inlet is to stop inputting the new ink into the mixing area when a mixture of the new ink and resident ink reaches a predetermined level in the tank.

13. The apparatus of claim 1, wherein the predetermined level is above the first inlet.

14. The apparatus of claim 1, wherein the first inlet inputs the new ink into the mixing area of the tank at a same time the second inlet inputs the resident ink into the mixing area of the tank.

15. An apparatus, comprising:

a tank including a mixing area;

a first inlet to input first ink into the mixing area; and a second inlet to input second ink into the mixing area, wherein at least one of the first inlet or the second inlet extends from a bottom of the tank, and wherein at least one of the first inlet or the second inlet is oriented in a direction to cause a respective one of the first ink or the second ink to flow along a side wall of the mixing area of the tank to mix the first ink with the second ink.

16. The apparatus of claim 15, wherein:

the first ink is new ink, and the second ink is ink recirculated from a printer.

17. The apparatus of claim 15, wherein at least one of the first inlet or the second inlet extends from a bottom of the tank.

18. The apparatus of claim 15, wherein the first inlet inputs the first ink into the mixing area of the tank at a same time the second inlet inputs the second ink into the mixing area of the tank.

* * * * *